United States Patent [19]

Miller, Jr. et al.

[11] 4,378,918

[45] Apr. 5, 1983

[54] QUASI-STABILIZATION FOR LINE OF SIGHT GUIDED MISSILES

[75] Inventors: Walter E. Miller, Jr.; James W. McKelvy, both of Huntsville, Ala.

[73] Assignee: The United States of America as represented by the Secretary of the Army, Washington, D.C.

[21] Appl. No.: 223,863

[22] Filed: Jan. 9, 1981

[51] Int. Cl.[3] ..... F41G 7/20

[52] U.S. Cl. ..... 244/3.11

[58] Field of Search ..... 244/3.11, 3.12, 3.13, 244/3.14, 3.1

[56] References Cited

U.S. PATENT DOCUMENTS 2,944,763 7/1960 Grandgent et al. ..... 244/3.14

3,233,847 2/1966 Girsberger ..... 244/3.12

3,366,346 1/1968 McKnight et al. ..... 244/3.11

3,807,658 4/1974 Miller, Jr. et al. ..... 244/3.13

FOREIGN PATENT DOCUMENTS 1301041 12/1972 United Kingdom ..... 244/3.14

*Primary Examiner*—Charles T. Jordan

*Attorney, Agent, or Firm*—Nathan Edelberg; Robert P. Gibson; Robert C. Sims

[57] ABSTRACT

An open loop reduction in gunner aiming error is provided by a rate gyro feedback to the missile command electronics. The low frequency movements are filtered out of the feedback circuit; permitting tracking of low frequency crossing targets, while eliminating higher frequency gunner jitter inputs.

6 Claims, 6 Drawing Figures

QUASI-STABILIZATION FOR LINE OF SIGHT GUIDED MISSILES

DEDICATORY CLAUSE

The invention described herein may be manufactured, used, and licensed by or for the Government for governmental purposes without the payment to us of any royalties thereon.

BACKGROUND OF THE INVENTION

Figure 1:
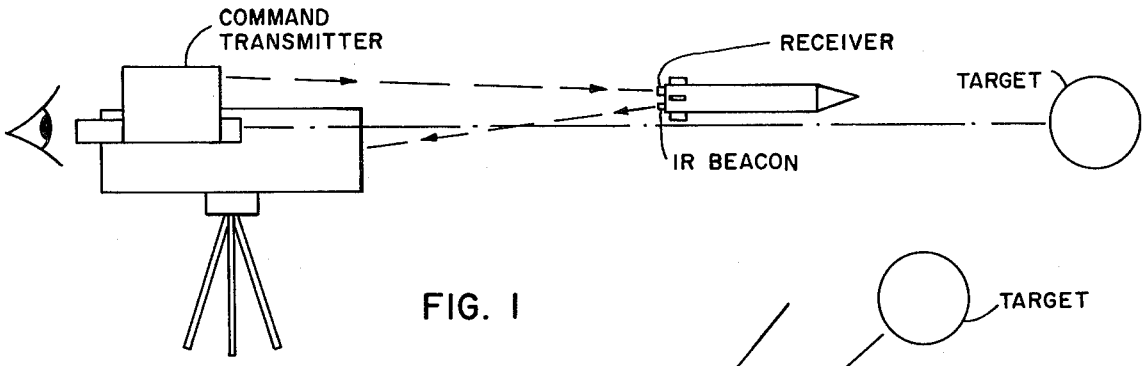
FIG. 1 is a diagrammatic showing of a line of sight guided missle system.
Figure 2:
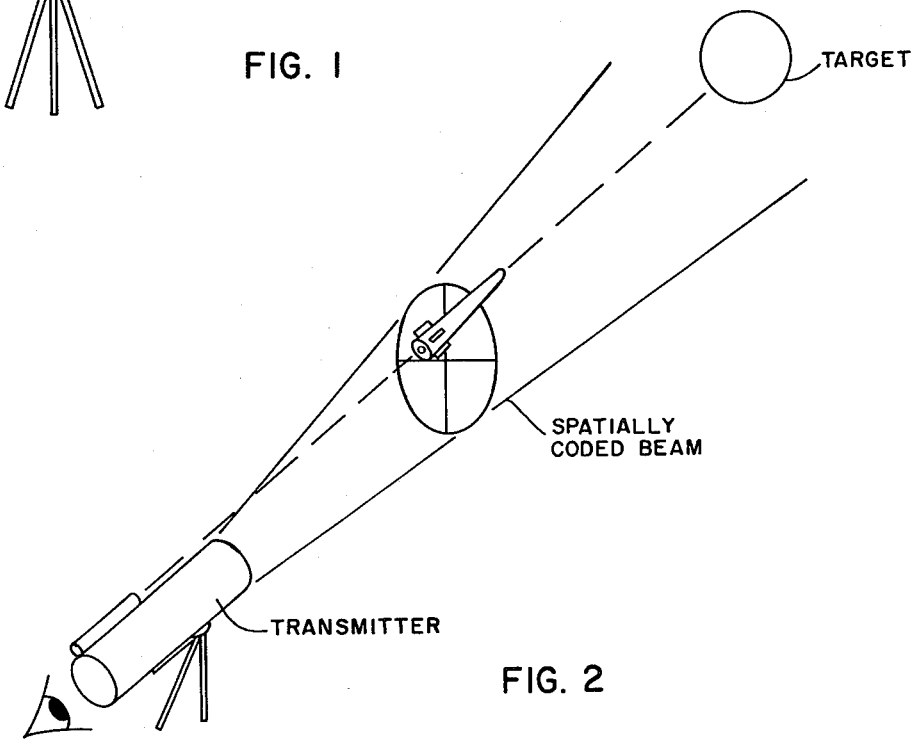
FIG. 2 is a diagrammatic showing of the optical beamrider guided missle.

FIG. 1 depicts a functional implementation of a line of sight guided missile. A gunner aims a telescope, night sight, or other sighting device at a target. Boresighted with the sight on a common chasis is a missile guidance device, such as a tracker (as used in Tow, Dragon, Shillelagh, and several foreign missiles). Alternatively, the guidance device may be the beam projector unit of a beamrider data link as shown in FIG. 2.

In either case, the missile ultimately receives guidance commands which constrain it to fly within a very narrow corridor about the established line of sight, and thus eventually impacts the target. Accuracy of these systems is normally limited by the gunner's inability to perfectly track the target centroid. This gunner jitter has historically been reduced by various means:

a. Mechanical Aids. The sling on a rifle is an example of a mechanical aid, which permits muscular tension to be controlled for gunner aiming optimization. The Dragon missile system provides another example. The missile launch tube contains an extensible leg on the forward end to provide mechanical support which somewhat reduces the gunner aiming errors. A machine gun tripod is another example of a mechanical aid to pointing.

b. Damping Devices. The Tow system provides a good example of mechanical damping to aid gunner jitter reduction. A tripod is used which contains a viscous damping device (in principal similar to an automobile shock absorber). This permits easy manipulation of the sighting device at low frequencies required for tracking, but attenuates the higher frequencies to reduce total aiming jitter.

c. Stabilization. Several aircraft employ sights and/or sensors which are mounted on an inertially stabilized platform, isolated from vehicle angular motions. The Stinger Alternate sight is a man-carried guidance unit which used inertial sensors to stabilize the line of sight. Here the sensors all receive their input energy through reflection from a mirror, which is stabilized in one direction, and ½ angle controlled in a perpendicular direction, to provide a stable line of sight in the presence of gunner jitter.

All of these techniques are presently in use in various forms but all require considerable weight and volume compared to the proposed approach, which we call quasi-stabilization.

d. Line of Sight Rate. Some missile guidance systems measure the low frequency angular rate of the gunner to aid missile guidance for crossing targets (reducing a missile lag in following the moving line of sight). This is in no way related to the subject patent, which by comparison measures high frequency angular position to correct for gunner jitter. However, both methods could be simultaneously used for improved performance, and even a common sensor used. In this case, a rate gyro could be used for the crossing target line-of-sight rate bias, and this angular rate information electronically integrated to provide angular position data for quasi-stabilization.

Line of sight stabilization requires an error sensor (gyro), servo mechanism, and associated electronic, processing, and moveable mechanical components. In return it provides any desired degree of isolation from external angular motions. Quasi-stabilization may not provide this same high degree of isolation, will provide adequate isolation for many applications without requiring moveable parts and servo mechanisms.

DESCRIPTION OF THE PREFERRED EMBODIMENT

The present invention uses the sensor to measure such motions (gunner jitter) without the mechanical components to remove them and offers a considerable saving in size and weight. The gunner is then required to view an unstabilized scene to perform his target tracking task. However, inertial measurement of his tracking errors permits the missile guidance processor to remove most of this jitter missile guidance data. For a beamrider, this may be done using the line of sight rate bias function (U.S. Pat. No. 3,807,658); for a missile tracker the jitter is simply subtracted from the tracker's output to provide an "open loop" correction of missile guidance signals based on measurement of gunner jitter.

Figure 3:
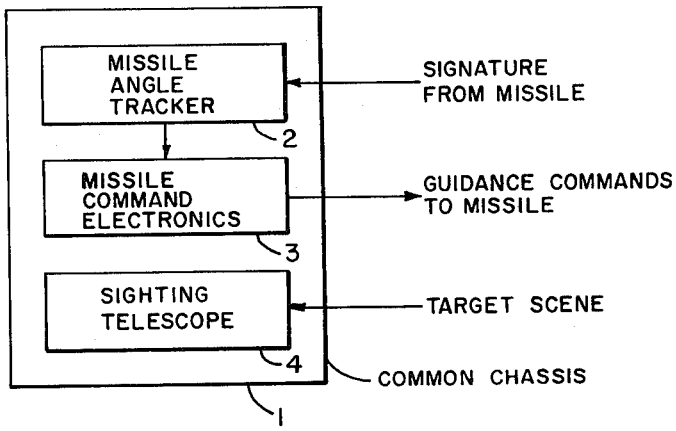
FIG. 3 is a block diagram depicting the basic system of FIG. 1.

FIG. 3 shows a functional block diagram of a simple implementation to which this method may be applied. The block 1 indicates all blocks within it are mounted to a common rigid chassis, and are moved as a single unit. Block 4 is a conventional sight such as an optical telescope by which the gunner aims chassis 1 as desired. Block 2 is optically boresighted to 4, and thus is also aimed at the target, and measures missile deviation from this axis. The missile command electronics 3, provides appropriate guidance commands to return the missile to the line of sight if an error is measured by 2. Conventional command to line of sight guidance components are used in the blocks.

Figure 4:
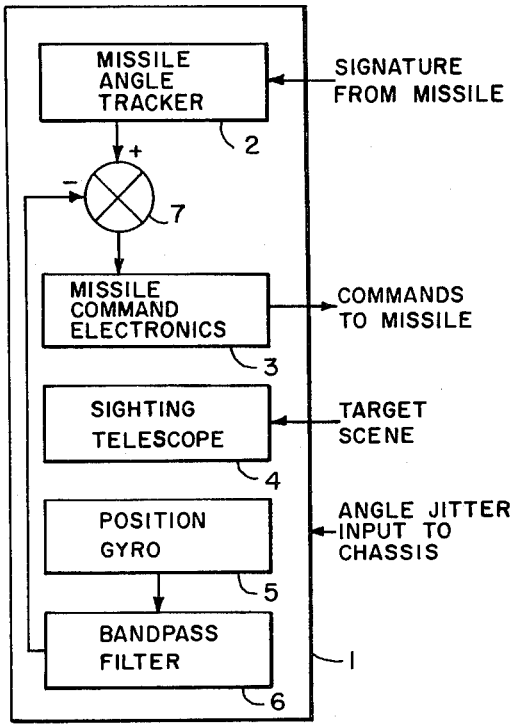
FIG. 4 is a block diagram which illustrates a basic concept of the present invention, as applied to the basic system of FIG. 1.

FIG. 4 shows a similar guidance system, with the addition of quasistabilization. A position gyro 5 measures positional variations of common chassis 1. These are then subtracted (7) from the missile tracker 2 signal, which eliminates those angle measurement components due to chassis angular motions. In practice bandpass filter 6 would be employed to permit very low frequency chassis motions to be rejected from the correction circuitry. This in turn permits the gunner to track a slowly crossing target without the quasi-stabilization circuitry (5, 6, 7) removing such motion as error. A high frequency cutoff of the filter (above gunner jitter frequencies) is used to reject electronic noise from the gyro.

Figure 5:
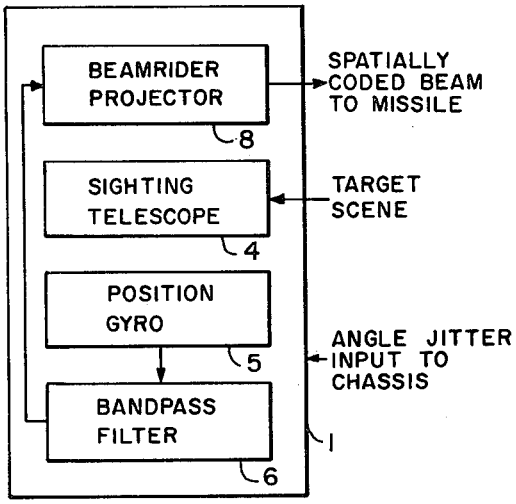
FIG. 5 is a block diagram illustrating the basic concept of the invention in a beamrider system.

FIG. 5 shows a similar application using a beamrider rather than missile tracker. In this case the beam bias input of Projector 8 is used for the jitter correction signal. (See U.S. Pat. No. 3,807,658). This provides an electronic null offset in the projected beam equal to the angular jitter to be removed, and so no net disturbance is perceived by the missile sensor due to the angular jitter of chassis 1.

Figure 6:
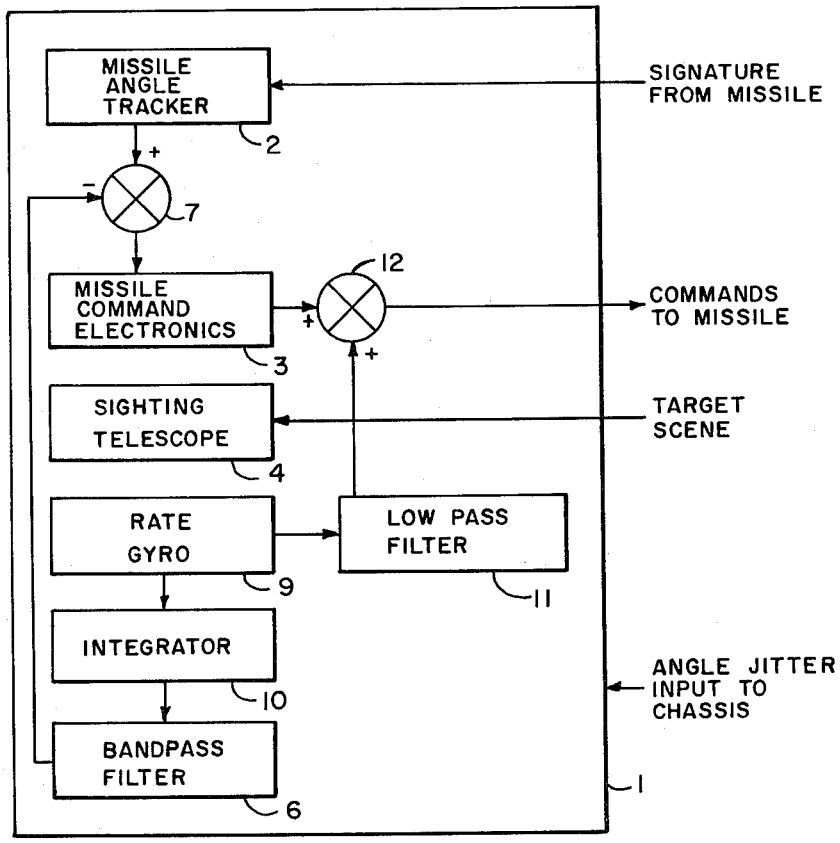
FIG. 6 is a block diagram illustrating the preferred embodiment of the present invention.

FIG. 6 shows a preferred embodiment and best mode with a missile tracker. A similar preferred embodiment with a beamrider projector is also obvious to those skilled in the art and so is not shown. In this case, a rate gyro 9 is shown low pass filtered by 11 to reduce electronic noise, and this signal directly added to the command signal at 12 in order to provide a rate bias in missile commands to offset the lag effects of a crossing target. In addition integrator 10 produces position output signals from the rate gyro input. These position signals are bandpass filtered (6) and subtracted from the missile tracker position signals (7) in a manner identical to FIG. 4, to reduce gunner jitter effects. Low pass filter 11 actually provides the rate bias signals at low frequencies where bandpass filter 6 does not permit subtraction at 7, i.e. at frequencies associated with target crossing angular rates.

We claim:

1. In a system wherein a sighting device is aimed with unwanted angle jitter at a target, a missile is guided towards said target along a boresight of said sighting device by a control device which sends guided control signals to said missile to bring said missile into the boresight line of said sighting device, the improvement comprising a gyro mounted to a chassis and having an output signal at its output which is a measure of movement of said chassis; a bandpass filter having an input and an output; the output signal of said gyro being connected to the input of said bandpass filter; the output of said bandpass filter being connected to said control device so as to subtract the signal output of the bandpass filter from the guided control signals to be sent to said missile; said bandpass filter blocks the passing of low frequency signals from the output signal of said gyro such as those produced in tracking a target; said bandpass filter further blocking high frequency output signals from said gyro such as those generated by electronic noise; and said bandpass filter allowing to pass signals from said gyro which are in the angle jitter frequency range so as to eliminate from the guidance of the missile most unwanted angle jitter input.

2. A system as set forth in claim 1 wherein said gyro is a position gyro.

3. A system as set forth in claim 1 wherein said gyro is a rate gyro.

4. A system as set forth in claim 1 or claim 3 further comprising an integrator connected between said gyro and said bandpass filter.

5. A system as set forth in claim 4 further comprising a missile tracker device mounted to said chassis which produces an error signal in accordance with said missiles' deviation from said boresight; a subtractor having first and second inputs and an output; said first input of said subtractor being connected to receive error signal from said tracker device; said second input of the subtractor being connected to the output of said bandpass filter so as to subtract the output signal from the bandpass filter from that of the tracker device; and the output of the subtractor being connected to said control device so as to provide guidance control signals which will command the missile to correct its error position with respect to said boresight, having had some unwanted chassis jitter removed as a system error source.

6. A system as set forth in claim 5, further comprising an adder having first and second inputs and an output; the output of said control device being connected to said first input of the adder; the output of said adder providing the guidance control signals; a low pass filter being connected between the output of said gyro and the second input of said adder whereby low frequencies such as those produced by the tracking of a crossing target will be added as a crossing rate bias to the guidance control signals.

* * * * *